United States Patent [19]

Loewe

[11] 4,092,760

[45] June 6, 1978

[54] TRAVELLING SUPPORT FOR SCAFFOLDING

[75] Inventor: Henri Loewe, Paris, France

[73] Assignee: Societe Francaise des Echafaudages Self-Lock, Aulnay-sous-Bois, France

[21] Appl. No.: 719,370

[22] Filed: Sep. 1, 1976

[30] Foreign Application Priority Data

Sep. 12, 1975 France ..... 75 28073

[51] Int. Cl.[2] ..... B60B 33/02

[52] U.S. Cl. ..... 16/35 R; 16/29

[58] Field of Search ..... 16/29, 31 R, 31 A, 44, 16/35 R; 280/763, 767, 113; 182/15, 39, 35

[56] References Cited

U.S. PATENT DOCUMENTS

| | | | |
|---|---|---|---|
| 483,038 | 9/1892 | Begley | 16/29 X |
| 1,393,842 | 10/1921 | Slater | 16/29 X |
| 3,228,089 | 1/1966 | Turner | 16/35 R X |
| 3,237,940 | 3/1966 | Johnson | 16/35 R X |
| 3,463,505 | 8/1969 | German et al. | 16/30 X |

FOREIGN PATENT DOCUMENTS

| | | | |
|---|---|---|---|
| 231,987 | 12/1959 | Australia | 182/15 |
| 192,783 | 2/1938 | Switzerland | 16/44 |
| 1,251,204 | 10/1971 | United Kingdom | 16/31 |

*Primary Examiner*—Dorsey Newton

[57] ABSTRACT

The travelling support for scaffolding comprises a holder, means for locking said holder on an upright of the scaffolding, a shaft fixedly mounted on said holder, a spindle placed in said shaft and a fork for supporting a wheel hingedly mounted on said spindle.

7 Claims, 2 Drawing Figures

TRAVELLING SUPPORT FOR SCAFFOLDING

The present invention relates to a new travelling support for scaffolding, support which can be very easily placed and removed.

There already exists various types of travelling support which comprises a frame having the possibility to be fixed to an upright of a scaffolding, said frame exhibiting a girder or arm beneath which a wheel is hingedly mounted. The presently existing supports are heavy, and of a difficult assembling; they require most of the time the use of dismountable parts which very often risk to get lost on the worksite.

The present invention creates a new travelling support of a great simplicity, which can be mounted in a short time and which can further comprise suspension means greatly facilitating removal of the scaffoldings because they permit to absorb the un-evenness of the ground. Besides, the wheel of the support of the invention can indifferently either swivel freely or be fixed angularly to the scaffolding, and that in a plurality of positions.

According to the invention, the travelling support for scaffolding comprises a holder, means for locking said holder on an upright of the scaffolding, a shaft fixedly mounted on said holder, a spindle placed in said shaft and a fork for supporting a wheel hingedly mounted on said spindle.

Various other features of the invention are moreover shown in the following detailed description.

An embodiment of the invention is shown by way of non restrictive example in the accompanying drawing, wherein.

Figure 1:
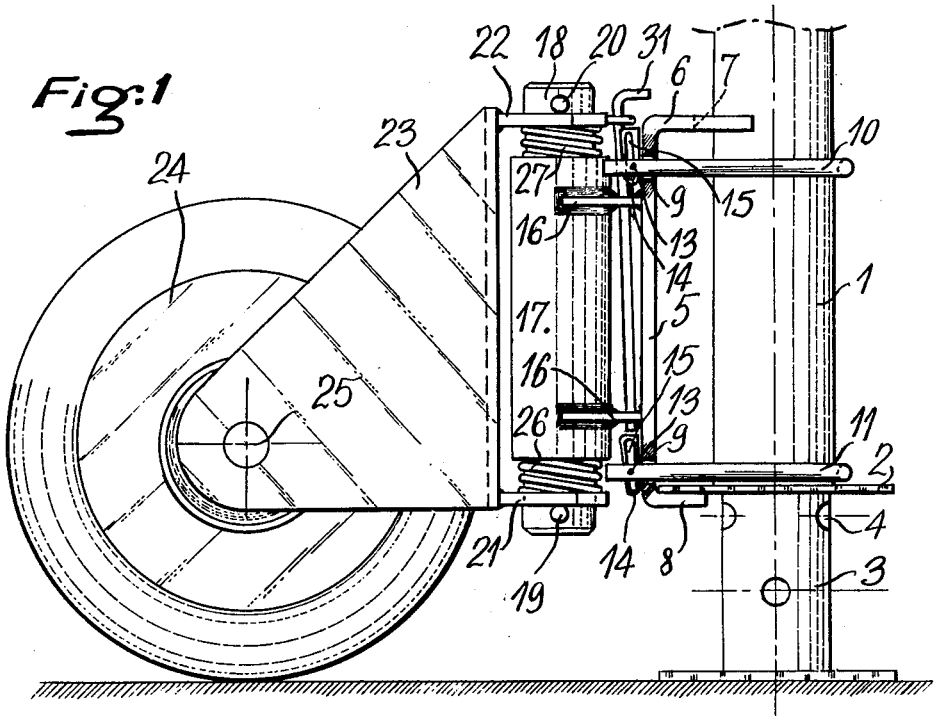
FIG. 1 is a lateral elevation view of the travelling support for scaffolding, according to the present invention.

In the drawing, 1 designates a scaffolding upright provided at the lower portion thereof with a plate 2. The upright 1 is supported by a foot-jack 3 which can be merely constituted of a tube telescopically engaged in the upright 1, the plate 2 of which then bearing on a pin (not shown) passed through a set of holes 4.

Figure 2:
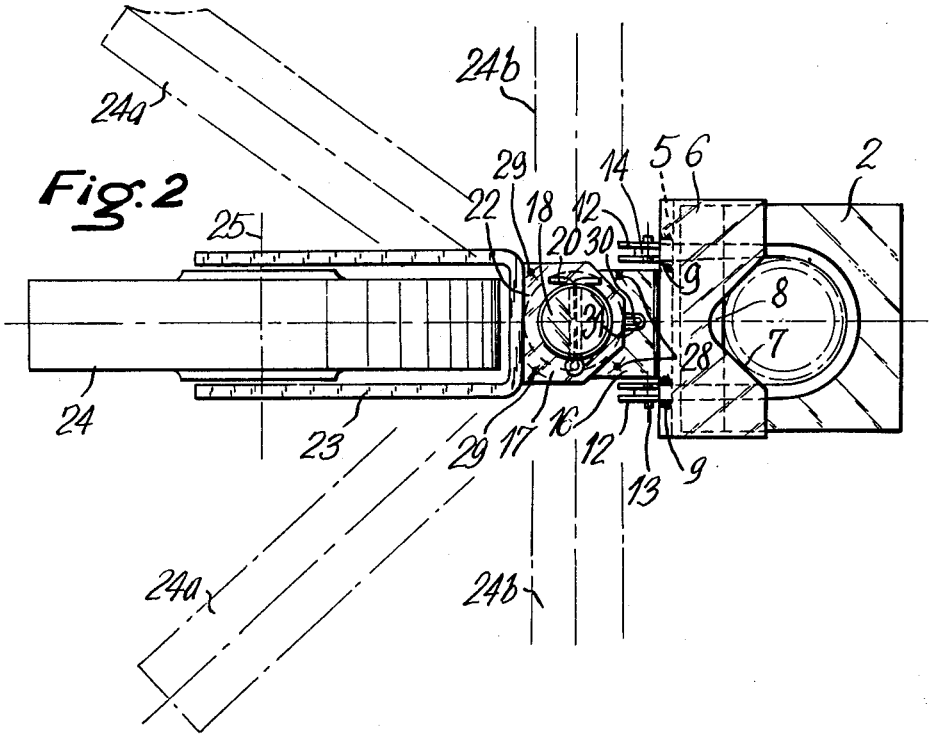
FIG. 2 is a top view of FIG. 1.

The properly so-called travelling support comprises a holder 5 with a vertically positioned bottom portion, said holder having an upper arm 6 in which is provided a notch 7 designed to partially surround the upright 1. FIG. 2 shows that the notch 7 can typically be sustantially of a V shape in order that its convergent edges be adaptable on uprights 1 of any shapes and sizes. The lower arm 8 of the holder 5 is of a rectangular shape in the present example and bears below the plate 2. It would not be outside the scope of the invention to realize the lower arm 8 in the same way as the upper arm 6, i.e. so that said lower arm 8 will also have a notch similar to notch 7.

The bottom portion of the holder 5 has two sets of holes 9. The sets of holes 9 are used for the passage of ends of U-shaped belts 10, 11 which are provided to partially encircle the upright 1. The ends of the belts 10, 11 are each advantageously shaped to delimit fork-joints 12 in which passes a removably mounted pin 13 on which is mounted a key-bolt 14 with an oblique aperture 15.

FIG. 1 shows that knocking on the top of the key-bolt 14 causes tightening of the corresponding belt on the upright 1 and, consequently, tightening the latter in the bottom portion of the notch 7 and applying with force the plate 2 against the bottom portion of the holder 5.

The holder 5 is provided, on its side opposite to the side facing the upright 1, with lugs 16 which are welded on a tubular shaft 17 in which is passed a spindle 18 which can indifferently be solid or tubular.

Pins 19, 20, for example constituted by pins as illustrated in FIG. 1, pass through the ends of the spindle 18 and bear against plates 21, 22 slipped on said spindle 18 and being secured to a fork 23 in which is placed a wheel 24 which is rotatable about a spindle 25. Springs 26, 27 are interposed between the plates 21, 22 and the ends of the shaft 17, whereby the fork 23 as well as the spindle 18 and of course the wheel 24 can axially move a certain distance with respect to the shaft 17. The plates 21, 22 are slipped on the spindle 18 to rotate relatively thereto, and also it is advantageous that said spindle 18 be rotatably mounted inside the shaft 17.

Holes 28 are bored in the lugs 16 or at least in one of them, and holes 29 are bored in the upper plate 22. Besides, an eye 30 is formed by the plate 22 in a way diametrically opposed to the fork 23. A pin 31 is designed to be passed in the eye 30 and one of the holes 28, or to be passed in one of the holes 29 and one of the holes 28.

Providing that the holes 29 be offset by 90° to the holes 28, it can be seen in FIG. 2 that it is possible either to maintain the wheel 24 in the position represented in full line, or to bring said wheel in one of the two positions 24*a* if the pin 31 is passed in the eye 30 and one or the other of the holes 28, or still to bring said wheel 24 in one or the other of the positions 24*b* if the pin 31 is passed in one of the holes 29 and one of the holes 28. As shown in FIG. 1, pin 31 passes through both the upper and lower lugs 16. However, the pin 31 may pass only through the upper lug 16, if desired. Naturally, the embodiment shown in the Figure, with the pin 31 passing through both the upper and lower lugs, better secures the wheel in position.

As it appears from the above disclosure, the holder 5 and the belts 10, 11, ensure blocking of the support on the upright 1 when the key-bolts 14 are pushed and act as wedges. The whole support cannot slide since the load supported by the upright 1 is transmitted by the plate 2 on the arm 8 of the holder 5. The load applied to the upright 1 is consequently transmitted to the shaft 17 and the springs 26, 27 act as suspension elements.

When a pin 31 is not utilized, then the wheels 24 can swivel in any direction.

The invention is not restricted to the embodiment shown and described in detail, for various modifications thereof can moreover be applied thereto without departing from the scope of the invention as shown in the appended claims.

I claim:

1. Travelling support for a scaffolding upright, said support comprising:

a holder;

means for releasably locking said holder in a multidirectionable way on the scaffolding upright;

a shaft fixedly mounted on said holder;

a spindle placed in said shaft; and a fork for supporting a wheel hingedly mounted on said spindle, the means for releasably locking the holder on the upright of the scaffolding comprising at least one wedge shaped key-bolt bearing against said holder and one U-shaped belt having ends passing through the bottom portion of said holder and cooperating therewith to form a stop for said wedge shaped key-bolt.

2. Support as set forth in claim 1, wherein said key-bolt includes an oblique aperture, and wherein said belt includes ends in the form of fork-joints, and further comprising a pin crossing through said fork-joints and passing in the oblique aperture of the key-bolt.

3. Travelling support for a scaffolding upright, said support comprising:

a holder;

means for releasably locking said holder in a multi-directionable way on the scaffolding upright;

a shaft fixedly mounted on said holders;

a spindle placed in said shaft;

a fork for supporting a wheel hingedle mounted on said spindle; plates secured to the fork and slipped onto said spindle; and springs interposed between said plates and ends of the shaft supporting the spindle, whereby said springs act as suspension means between said shaft and the supporting fork of the wheel.

4. Support as set forth in claim 3, further comprising fixing lugs for connecting the shaft to the holder, said fixing lugs including holes, and a pin passing through said holes in said fixing lugs and into at least one of the plates connecting the spindle to the fork of the wheel, whereby said fork can be held in various angular positions fixed with respect to the holder.

5. Support as set forth in claim 4, wherein the pin holding the wheel in angular positions fixed with respect to the shaft passes simultaneously through one of the plates of the fork of the wheel and the lugs connecting the shaft to the holder, whereby said pin is axially guided while having a possibility to slide upon the clearances of the suspension means.

6. Travelling support for a scaffolding upright, said support comprising:

a holder;

means for releasably locking said holder in a multi-directionable way on the scaffolding upright;

a shaft fixedly mounted on said holder;

a spindle placed in said shaft;

a fork for supporting a wheel hingedly mounted on said spindle; retaining pins in the shape of pegs passed through the spindle; and plates secured to the supporting fork of the wheel and bearing against said pins, said plates being slipped onto said spindle.

7. Travelling support for a scaffolding upright, said support comprising:

a holder;

means for releasably locking said holder in a multi-directionable way on the scaffolding upright;

a shaft fixedly mounted on said holder;

a spindle placed in said shaft; and a fork for supporting a wheel hingedly mounted on said spindle, said holder having an upper arm into which is formed a slot with convergent edges tightened on the upright of the scaffolding, said upright having a foot jack at a lower end thereof, said foot jack including a plate substantially perpendicular to said upright, said holder having a second arm forming a support for said plate.

* * * * *